US006257829B1

(12) United States Patent
Seeley et al.

(10) Patent No.: US 6,257,829 B1
(45) Date of Patent: Jul. 10, 2001

(54) COMPUTERIZED METHOD FOR POSITIONING SUPPORT JACKS UNDERNEATH INDUSTRIAL GAS TURBINES

(75) Inventors: Charles E. Seeley, Latham; Ramanath I. Ramakrishnan, Clifton Park; Weiping Wang, Schenectady, all of NY (US); James Claeys, Point-Anderson; Al McCallum, Simpsonville, both of SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/504,929

(22) Filed: Feb. 16, 2000

(51) Int. Cl.[7] ..... F01D 25/26
(52) U.S. Cl. ..... 415/213.1; 269/555
(58) Field of Search ..... 415/213.1; 269/71; 248/554, 555, 556, 557

(56) References Cited

U.S. PATENT DOCUMENTS 3,628,884 * 12/1971 Mierley, Sr. ..... 415/219
4,050,660 * 9/1977 Eggmann et al. ..... 248/19
5,065,959 * 11/1991 Bhatia et al. ..... 248/554 X
5,307,676 * 5/1994 Gutman ..... 269/71 X
5,659,939 8/1997 Whitehouse ..... 269/296 X

OTHER PUBLICATIONS

"Skitters and Jacks: Interactive 3D Positioning Tools," E.A. Bier, Proceedings of the 1986 Workshop on Interactive 3D Graphics, Oct. 23–24, 1986, pp. 182–197.

* cited by examiner

*Primary Examiner*—John E. Ryznic
(74) *Attorney, Agent, or Firm*—Nixon & Vanderhye P.C.

(57) ABSTRACT

A computer model of a gas turbine is analyzed using finite element analyses to determine the height of support jacks underneath the casing of the gas turbine. The computer model defines the gas turbine casing as an array of data points. Each data point includes information regarding the spatial location of the point and the mass (or weight) of the gas turbine with respect to that point. By applying finite element analysis, the load due to gravity and resulting deformation at each point on the gas turbine can be predicted. Jacks supporting the gas turbine are also simulated in the model to compensate for the casing deformation due to gravity. Results using the proposed iterative algorithm indicate the correct jack heights to minimize casing distortion.

6 Claims, 4 Drawing Sheets

COMPUTERIZED METHOD FOR POSITIONING SUPPORT JACKS UNDERNEATH INDUSTRIAL GAS TURBINES

BACKGROUND OF THE INVENTION

The field of this invention relates to installation and assembly of large and heavy industrial machines, such as those installed at power utilities and manufacturing facilities.

In a preferred embodiment, the invention is a system for automatically predicting the proper adjustment height for support jacks underneath an industrial gas turbine to minimize distortion of the turbine due to gravity. Industrial gas turbines are large and heavy turbo machines that generate electrical power. These gas turbines typically weigh several tons. This enormous weight is sufficient to deform the gas turbine and cause misalignments of its components. For example, the deformation occurring during assembly of the gas turbine may cause the turbine's upper casing to not fit properly on the lower casing of the turbine. There is a need to provide supports for a gas turbine that compensate for deformation of the turbine due to gravity.

Gas turbines typically have modular casings for the compressor, combustor and turbine sections. Each casing module may have an upper and lower casing section that is assembled around the rotor components of the gas turbine. In a conventional assembly process, the lower half of the casings are installed on a concrete base or other platform. Jacks are positioned below the lower casing sections to support the gas turbine. The height of the jacks are adjustable to level the casing and correct for deformations in the casing. The jacks are necessary to compensate for the difference of flexural behavior when the top half casings are unbolted or absent compared for that with the upper half casings assembled. Such is the case when the rotor must be installed and aligned.

The amount of deformation in a gas turbine casing due to gravity may be on the order of millimeters or thousandths of an inch. This amount of deformation, especially in the lower casing of a gas turbine, is sufficient to cause difficulties in installing the rotor components into the casing and in aligning the upper casing onto the lower casing. In addition, once the gas turbine is assembled, its entire weight may cause further deformation of the top and lower sections of the casings. These further deformations may result in misaligned rotor components within the gas turbines, especially with respect to the clearance between the rotor blades and the blade shrouds formed by the casing sections. The rotor blades of the compressor and turbines rotate, and their tips travel in circular paths within the gas turbine. Certain stages have blade tips are closely surrounded by shrouds that surround the circular path of the blade tips.

If the casing shrouds are out-of-round due to deformation of the casing, then there will be shroud sections having too large of a gap from the tips of the blades. This gap in a compressor will allow compressed air to escape between the compressor stages. In the turbine, a gap may allow hot gases to escape from the turbine without acting on the turbine blades. The escaping air and gases resulting from the excessive gaps between the casing shroud and blade tips will degrade the efficiency of the gas turbines.

The gas turbine casing is supported by jacks underneath the casing. In addition, the height of each jack can been individually adjusted to level the casing and compensate for deformations in the casing due to gravity. Conventionally, the height adjustments of the jack have been done manually by technicians installing or reassembling the casing. The technicians use their experience and other empirical information to adjust the jacks properly under the gas turbine's lower casing. This manual procedure consists of (a) incrementally raising and lowering one or more jacks below the gas turbine, and (b) measuring distortion of the casing for the gas turbine, and repeating steps (a) and (b) until the measured casing distortion is reduced to acceptable levels.

As the rotor components and other sections of the gas turbine are installed in the lower casing, the jacks may be iteratively adjusted to correct for additional deformation and misalignments that occur in the casing and rotor components. Similarly, as the upper sections of the casing are aligned with the lower casing, the jacks may again be adjusted to align the lower casing with respect to the upper casing and allow the gas turbine assembly to be completed. The jack placements and height adjustments are done by technicians who use their levels, and other tools to determine whether the gas turbine casing or other components are out of alignment or deformed.

This conventional process is problematic. The manual jack placement and adjustment procedure is tedious, time-consuming and expensive. The procedure is prone to errors due to mis-measurement of casing distortions, misalignment of jacks underneath the gas turbine and incorrect height positioning of the jacks. Errors in positioning of jacks and setting their relative heights lead to deformations in the casing of a gas turbine which in turn results in poor efficiency. For example, it is estimated that an increase as little as 0.010 inch (0.025 cm) in the gap between a compressor/turbine blade and the casing shroud will result in a $50,000 per year in extra fuel costs for a single utility gas turbine at a typical power generation facility. This excessive fuel cost may be avoided by reducing the gap such that the clearance between a compressor/turbine blade tip and the casing shroud is within three-thousands inch (+/−0.003 in. and +/−0.0076 cm) of the intended clearance between shroud and blade.

There is a long-felt need for an improved technique for positioning jacks underneath a gas turbine casing and for adjusting the height of these jacks to minimize distortions in the casing due to gravity. Furthermore, there is a need for a method that automatically determines jack placement and jack height. There is also a desire for a jack adjustment method that will enable technicians during assembly or reassembly of a gas turbine to properly position jacks and adjust their height, without having to repeatedly measure casing deformation and readjust jack heights. Accordingly, there is a long-felt need for an automatic jack placement and jack height adjustment technique that is not prone to human errors, that does not require excessive amounts of time to arrange jacks and set their heights, and that minimizes casing distortions in gas turbines to improve the performance of the gas turbine.

BRIEF SUMMARY OF THE INVENTION

A jack height adjustment method has been developed that employs computer modeling of the gas turbine and finite element analysis of the weight distribution and deformation of gas turbines to estimate the proper jack heights to support a gas turbine casing and avoid deformation of the casing due to gravity.

Computer modeling of machine structures, such as gas turbines, is relatively well known. Existing software modeling programs represent gas turbines as an array of points (nodes) that are interconnected in a grid or mesh having the shape of the gas turbine. Each point represents a position on the gas turbine or the casing of the gas turbine. The point is oriented in space by its spatial coordinates, e.g., x, y, and z Cartesian coordinate system that identify the points location on the gas turbine.

Each point on the gas turbine may be identified by its location on the gas turbine and in a coordinate system. The computer model of the gas turbine includes a database identifying the location of each point on the turbine with respect to a coordinate system established by for the model. A complete set of points forms a model of the physical shape of the gas turbine. This model may be used by engineers in designing the turbine and predicting its performance. The array of points can be used to generate 2-dimensional and 3-dimensional images of the gas turbine.

In addition, the computer model may include additional information about each point on the gas turbine, such as the mass of the gas turbine at each point in the model. For example, the additional data for each point may also include the mass and deformability (elasticity) of the gas turbine at each point in the model. Knowing the mass of each point of the gas turbine, the model can predict the weight distribution and the loads on each point in the model. The weight distribution (e.g., the load due to gravity) may be used with the data on the elasticity of the gas turbine to predict the deformations in the turbine due to weight.

Using the computer model of the gas turbine, finite analysis element techniques may be applied to predict the amount of deformation occurring in the casing of the gas turbine due to gravity. Finite element analysis is a widely-used mathematical technique to study how loads affect structures, such as gas turbines. Applying finite element analysis to a computer model of a gas turbine, it becomes possible to predict the effects of gravity on the gas turbine. The loads, stresses and deformation throughout the gas turbine can be reliably predicted using finite element analysis techniques that are commercially available in application software products. The finite element method determines the stresses and deformation with respect to each point in the mathematical grid model of the gas turbine. The combined stresses and deformations of all points in the gas turbine provide a useful prediction of the actual deformations in a gas turbine due to gravity.

Placement of jacks under the gas turbine casing may also be simulated with a computer model and finite analysis element. For purposes of the finite element analysis, the jacks are treated as upward forces applied beneath the gas turbine Gravity is treated as a downward force applied to the gas turbine. The computer modeling system and finite element analysis estimates the effect of the jack placement and jack forces on the deformation of the gas turbine. An optimization computer algorithm may be applied to determine the optimal jack position beneath the gas turbine and the optimal forces to be applied by each jack to minimize the deformation in the gas turbine casing.

Once the optimal jack forces are determined, the appropriate jack height can be automatically determined by the computer analysis. In particular, the computer analysis converts jack forces to a corresponding jack height to achieve the desired force. Once the computer has determined the optimal jack-positioning and jack height, the computer may generate a 2D or 3D display image or print out of the proper position for the jacks and their jack height. The technicians use the image or print-out to position the jacks and/or to adjust the heights of the jacks.

The invention is a jack-positioning algorithm implemented using a computer to determine the proper jack heights for placement beneath the turbine casing. By properly determining the optimal jack height, distortions in the turbine casing due to gravity may be reduced and assembly of the gas turbine improved. The invention has a benefit of reducing undesirable effects due to distortion in the turbine casing caused by gravity. By minimizing casing distortions, the alignment of the rotor in the turbine casing may be improved significantly resulting in a corresponding increase in turbine efficiency.

The jack-positioning algorithm eliminates the trial and error procedure previously used. The algorithm includes generating an analytical model, such as a computer simulation of a turbine casing that determines the weight distribution within the turbine casing and the deflection of the casing due to gravity, loading and jack placement. An index of the casing distortion due to gravity is generated that correlates the amount of casing distortion at the various points on the casing. An optimization process is performed on the index of distortion to minimize the total amount of distortion within the casing by iteratively adjusting the forces applied by the jacks underneath the turbine casing. Once the index of distortion has been minimized, the optimal jack forces are converted to jack heights. Output is generated as to jack placement and jack height for use by service technicians during assembly of the gas turbine casing.

DETAILED DESCRIPTION OF THE INVENTION

Figure 1:
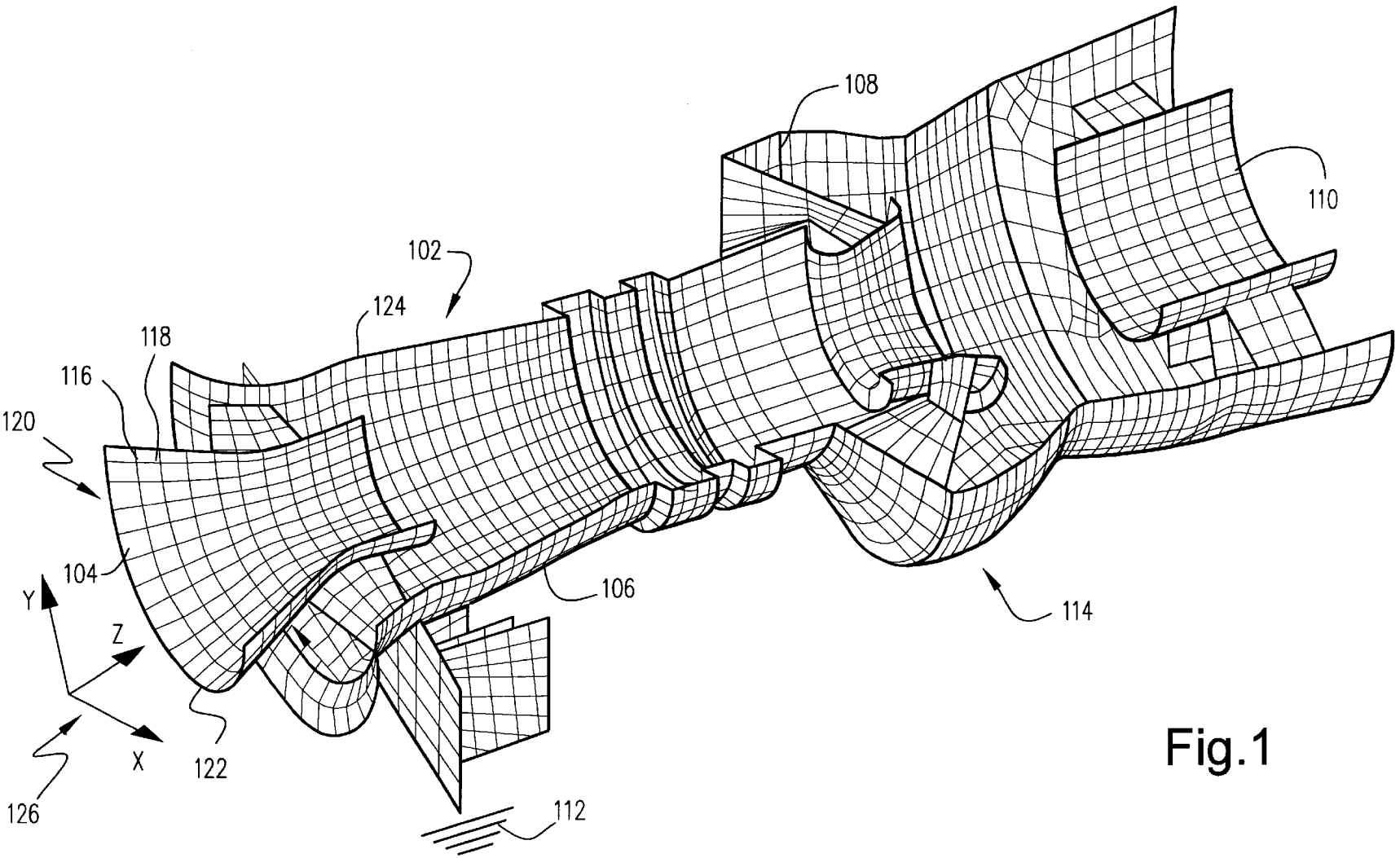
FIG. 1 is a perspective view of a grid model of a gas turbine and, in particular, the lower casing of a gas turbine.

FIG. 1 illustrates the lower half 102 of a casing for a gas turbine engine. The rotor components and top half 103 of the casing would be installed on the lower casing 102 after the lower casing had been positioned on a floor or other substrate. The lower casing 102 includes casing sections for air inlet 104, compressor 106, combustor 108 and turbine 110. During assembly, the lower half of the casing components 102 to 110, are installed and coupled together on a floor or other platform 112, typically in a power generation utility facility.

Once the lower casing 102 is fully assembled and installed, the rotor components (not shown) are installed into the lower casing. These rotor components typically include the rotor shaft, compressor blades and disks, turbine blades and disks and any other rotating components of the gas turbine. In addition, non-rotating components, such as the combustor, fuel system and stator blades are installed in the lower casing. Once the rotor components and associated components are in place in the lower casing, the upper casing (not shown) is installed over the rotor components and onto the lower casing 102.

The assembly process requires that the lower casing sections and rotor components be aligned with each other. The tolerances for the fit between casing sections and motor components to gas turbine are very small, and typically are only a few thousands of an inch. The casing sections and rotor components may be massive, and weigh several hundreds of pounds (or even tons) each. The typical rotor shaft is several meters long. To assemble these large massive sections and components is a difficult task performed by experienced service technicians. As the technicians assemble the casing sections and rotor components, the technicians continually check the alignment between the various components and sections to ensure that the tolerances in the fit between these components are satisfied.

FIG. 1 shows computer model 114 of a lower casing of a gas turbine. The computer model was formed by a computer-aided-design (CAD) and computer-aided-engineering (CAE) software programs. These programs create a mathematical model of the upper and lower casing sections and rotor components of the gas turbine. The model comprises a large array of data points 116, where each data point represents a node 118 in the grid 120 that forms the gas turbine casing image shown in FIG. 1. The grid 120 may be displayed as a wire mesh of longitudinal lines 122 that encircle the gas turbine, and lateral lines 124 that extend along the length of the gas turbine. The nodes 118 (corresponding to data points 116) are at the intersections between these longitudinal 124 and lateral lines 124 that form the image of the gas turbine model.

The computer model includes the spatial coordinates for each data point 116 (node 118) of the gas turbine casing 102. Spatial position of each data point 116 may be determined relative to all other data points of the mathematical model by use of a coordinate system, such as the Cartesian coordinate system represented by the x, y, z symbol 126. The mathematical model of the gas turbine casing stores the coordinates in the x, y, z system 118 for each data point 116 of the casing model. Using the data points and the coordinate system, a wire image (grid 120) of the casing 102 can be mathematically generated by a computer executing a computer aided design (CAD) program.

Information regarding the distribution of mass in the gas turbine is represented by the computer model, in addition to the data regarding the coordinates of each point of the gas turbine. Each of the data points 116 includes information regarding the mass (or weight) of the gas turbine. Applying finite element analysis techniques the deformation of the gas turbine due to gravity can be predicted. Finite element analysis determines the effect of gravity on each data point 116 (node 118) of the model of the gas turbine. Commercially available software programs will perform a finite element analysis of a gas turbine model to determine the deformation of the turbine due to gravity.

Figure 2:
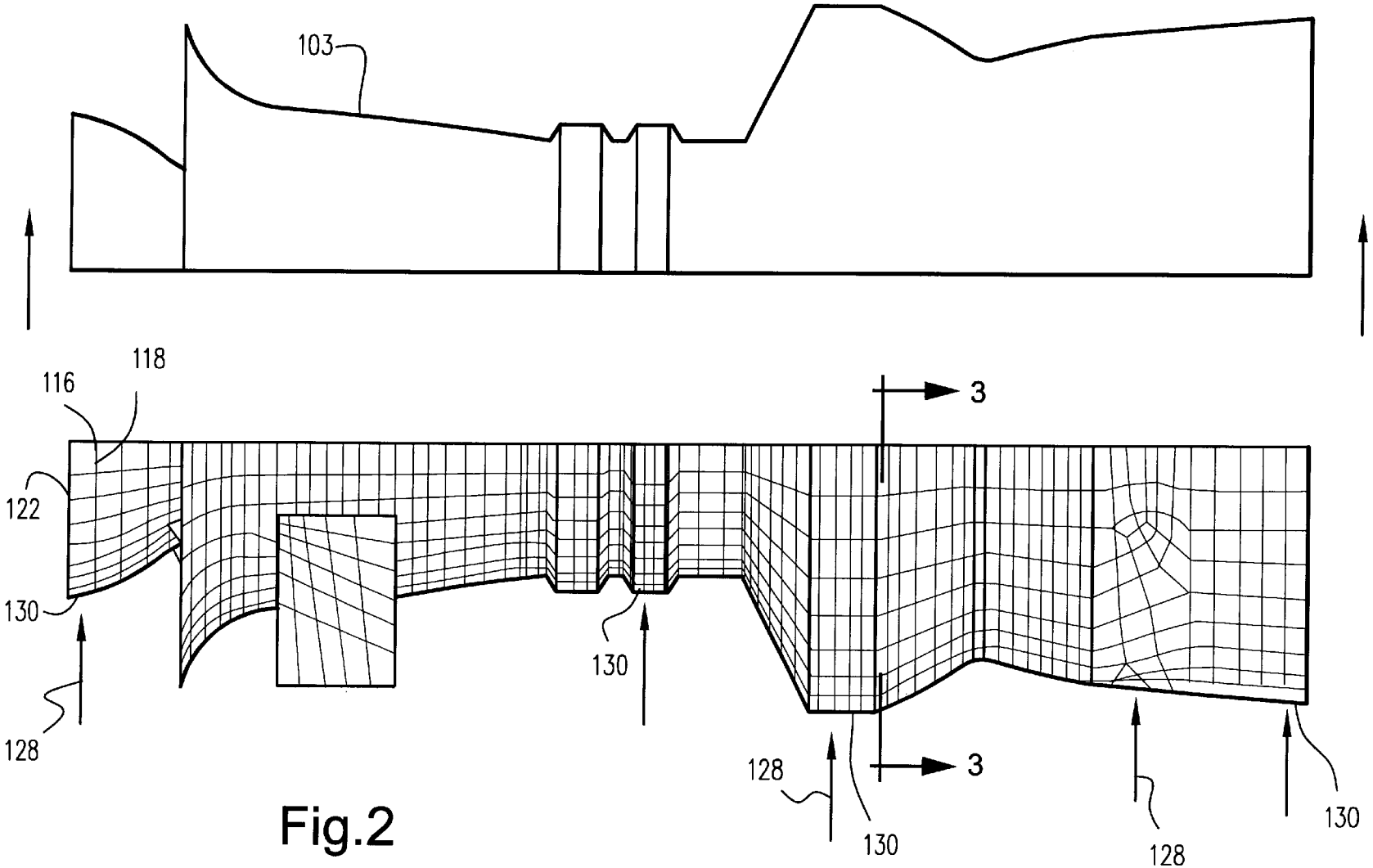
FIG. 2 is a side view of the grid model shown in FIG. 1, and illustrates jack locations underneath the casings.

As shown in FIG. 2, the jacks are simulated by the computer as forces 128 applied to the CAD model 114 of the casing of the gas turbine. A multiplicity of jacks may be used to support the casing. These forces are applied to the underside of the casing at location on the casing corresponding to where jacks are to be positioned. Generally, the underside of a gas turbine casing has jack couplings 130 at various locations on the casing. These jack couplings are designed to engage with a support jack. The jack couplings are usually located at reinforced areas of the casing, such as at flanges and other relatively thick portions of the casing. By positioning jack couplings at thick portions of the casing, the casing is better able to withstand the concentrated support forces of the jacks. In addition, the jack couplings are also distributed under the casing to evenly distribute the weight of the gas turbine over the jacks and to provide sufficient support to all of the gas turbines. An embodiment of the invention may be used during the design of a gas turbine to select the positions on the casing where jack couplings should be located to provide good distribution of the weight of the gas turbine on the supports. However, the preferred embodiment of the invention is employed after a gas turbine has been designed and during its the assembly. When used during the assembly of the gas turbine, the invention is used to optimize the height of the jack supports under the casing, where the jacks are positioned to engage the jack couplings under the casing.

During assembly of the casing, the technicians locate the jacks on the platform 112 at locations that are directly below the jack couplings. As the lower casing is assembled, the casing is mounted on the jacks. The other components of the gas turbine, such as the rotating compressor, shaft(s) and turbine, are mounted in the lower casing. In addition, the upper casing is aligned over and attached to the lower casing. The force of gravity acting on the mass of the gas turbine causes the lower casing and other components of the gas turbine to deform. As components are installed in the gas turbine, its mass continues to increase and the amount of deformation similarly increases. If left unchecked, the deformation of the gas turbine can result in misalignments between the components being inserted into the casing, and between the lower and upper casings.

Figure 3:
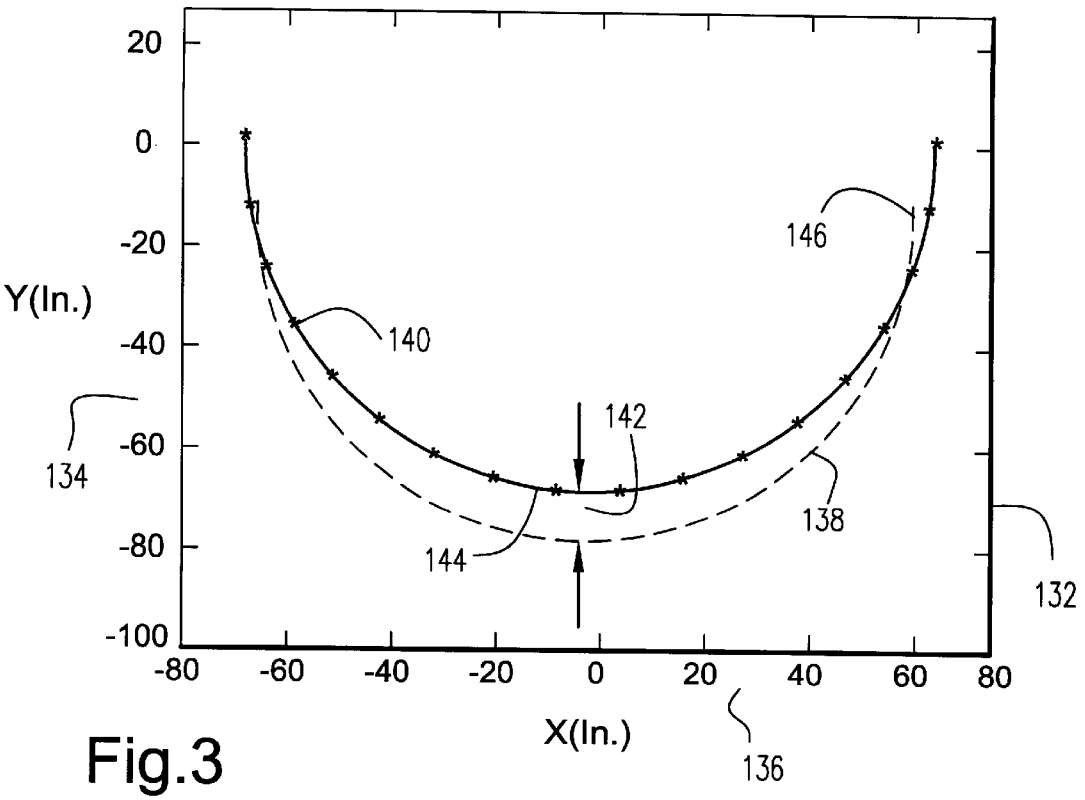
FIG. 3 is a chart of the casing deformation that shows a cross section of the model shown in FIG. 2.

FIG. 3 is a chart 132 of a computer generated simulation of the deformation of a cross—section along line 3—3 of the lower casing 102 along line 3—3 in FIG. 2. The chart shows the amount of vertical deformation 134 in the lower casing to the horizontal distance 136 across the casing. The dotted line 138 of the chart is a simulation of the casing deformation without any support from the jacks. The simulation is generated by a computer applying the force of gravity to the computer model of the gas turbine, and using a finite element analysis to determine the deformation due to gravity at each point in the gas turbine.

The solid line 140 of chart 134 indicates the desired cross-sectional outline for the casing along section line 3—3 in FIG. 2. The deformation gap 142 between this desired cross-sectional shape and the deformed shape 138 is an area that represents the deformation due to gravity. The gap 142 may be greatest at the bottom-center 144 of the casing and the deformation may pinch the sides of the casing inward 146 near the top of the lower casing. FIG. 3 illustrates the predicted deformation for one cross-section of the gas turbine based on the finite element analysis performed on the computer model of the gas turbine. This deformation analysis is also performed for other sections of the gas turbine and can provide deformation predictions for all points on the gas turbine. The deformation analysis provides a prediction regarding the amount of deformation of the gas turbine in terms of the distance between a desired location of a point on the surface of the gas turbine and the predicted position of that point after the force of gravity is taken into account.

To compensate for the deformation of the casing, a technician operates a computer system which models the gas turbine using a computer aided design (CAD) program and which predicts the amount of deformation due to gravity in the gas turbine using a finite element analysis program. The model may include the location of the jack supports for the gas turbine. These jack supports may be represented as simulated upward forces applied to the gas turbine casings at the jack coupling positions 120. The amount of force applied by each jack support is determined by finite element analysis to be that necessary to compensate for the predicted deformation in the casing. Accordingly, finite element analysis is used to determine the amount of vertical forces necessary at each jack positions to counteract the forces of gravity.

Figure 4:
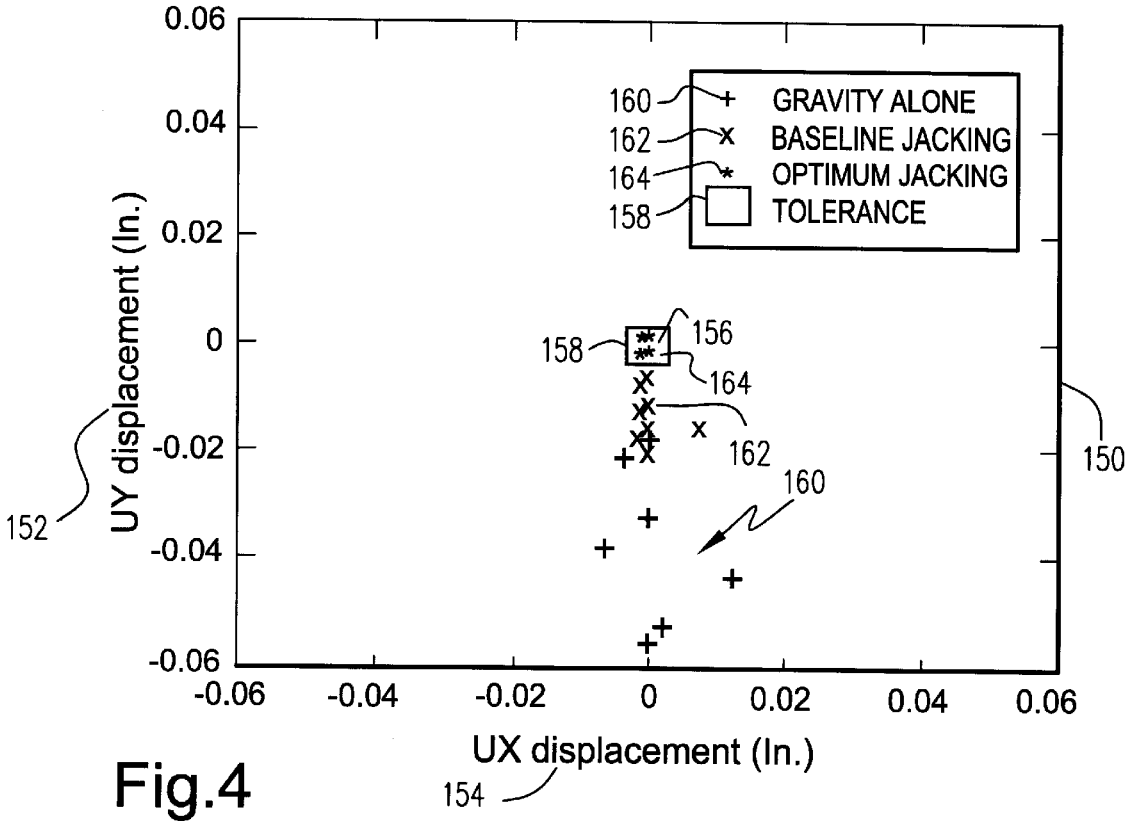
FIG. 4 is a chart of comparative test results showing turbine casing deformation due to gravity, deformation after the jack heights are manually set to a baseline displacements, and deformations after jack displacements are set to computer-determined values.

FIG. 4 is a chart 150 showing the predicted displacement for a group of jack couplings 130 on a gas turbine. The chart shows vertical displacement 152 and horizontal displacement 154 of each jack coupling with respect to the intended position 156. The intended position being that which results when the upper half casings are assembled. When the upper half casings are absent the flexure of the casings increases. The jacks compensate for this difference. A box 158 around the intended jack coupling position represents the acceptable tolerance of displacement of a jack coupling. The cross symbols (+)160 in the lower section of the chart represent the deformation of the casing due to gravity alone with no jacks supporting the casing. A baseline deformation shown by "X" symbols 162 as a baseline of jack forces which are representative of the initial jack height setting underneath the gas turbine. The star symbols (*) 164 represent the optimal jack forces as determined by finite element analysis. The optimal jack forces are calculated by applying an iterative optimization process to the finite element analysis. As can be seen in FIG. 3, the optimized jack forces compensate for the effects of gravity and minimize the deformation of the gas turbine to within tolerances. This determination of the optimal jack support forces is done on a computer and not by continually adjusting the jack supports. Once the necessary jack forces are determined, then a conversion can be applied to the forces to calculate the appropriate jack height for each jack support. Conventional jack height adjustments are then applied to adjust each jack to the proper height underneath the gas turbine.

Figure 5:
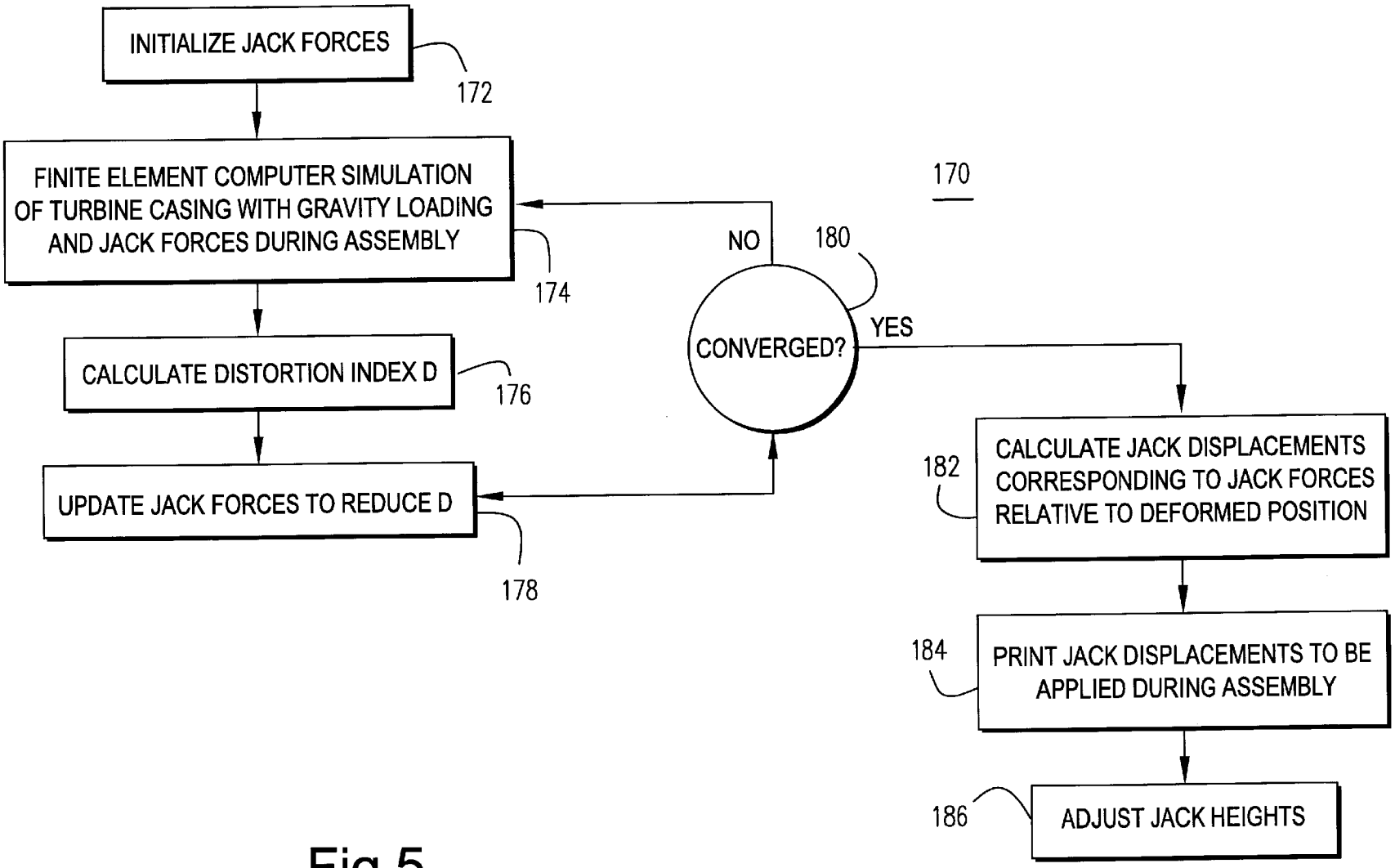
FIG. 5 is a flow chart of the steps of an exemplary embodiment of a method for determining jack height displacement.

FIG. 5 is a representative flow chart 170 of the steps used to determine the proper jack heights. The first step (172) is to initialize the jack forces in the finite element analysis. The initialization may involve positioning the jack forces under the points in the model corresponding to the jack couplings 130. In addition, initialization may be to apply a baseline force to the jack casing to compensate, at least partially, for the effects of gravity. The next step (174) is to execute a finite element computer analysis on the computer model (simulation) of the turbine casing or entire gas turbine. The finite element analysis is able to account for the effects of gravity (vertically downward) and those of the jack supports (vertically upward ). A distortion index is determined (step 176) for the gas turbine, such as that graphically represented in FIG. 4. The jack forces in the computer simulation are adjusted to compensate for the distortion index determined during the finite element analysis, in step 178. If the updated jack forces do not cause the distortion of the gas turbine to converge, then the deformation of the turbine is still outside the tolerances set for the design. Updating the jack forces and recalculation of the jack forces is done by applying finite element analysis techniques. If the distortion of the gas turbine is outside of tolerances, see step 180, then the finite element analysis is performed again to determine the casing distortion with new jack forces, see step 174.

When the distortion of the gas turbine is reduced to within the tolerance levels, then the jack forces have converged on an acceptable solution to the jack force determination, see step 180. These acceptable jack forces are converted to jack heights in step 182. The proper jack adjustments, i.e., heights, are printed out or otherwise displayed to the technicians who actually adjust the height of the jacks during gas turbine assembly, in steps 184 and 186. This predicted jack heights should reduce the deformation of the casing within tolerances in minimal time. This condition ensures the half casing deflection and full tube casing deflection optimally match one another. Accordingly, the technicians are freed from the tedious task of adjusting the jack heights in a sequential and repeating manner to minimize distortion of the gas turbine casing.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for adjusting jacks supporting a gas turbine casing comprising the steps of:

a) modeling the gas turbine as an array of data points where each data point includes data defining a spatial position of the point on the gas turbine and a mass or weight of the gas turbine at the point;

b) predicting deformation of the gas turbine due to gravity by applying a finite element analysis to the model gas turbine;

c) simulating the support jacks as jack forces applied to jack coupling points;

d) determining the jack height necessary to compensate for the predicted deformation of the gas turbine, and e) adjusting the jacks to the determined height.

2. A method for adjusting jacks supporting a gas turbine as in claim 1 wherein step (d) is performed by determining the jack forces needed to compensate for the predicted gas turbine deformation.

3. A method for adjusting jacks supporting a gas turbine as in claim 1 wherein the jacks are three or more.

4. A method for adjusting jacks supporting a gas turbine casing having an upper and lower casing halves, wherein the method comprise the steps of:

a) modeling at least the lower casing half of the gas turbine as an array of data points where each data point defines a spatial position of the point on the gas turbine and a mass or weight of the gas turbine acting on the point;

b) predicting deformation of the lower casing of the gas turbine due removal of the upper casing by applying a finite element analysis to the model gas turbine;

c) simulating the support jacks as jack forces applied to jack coupling points beneath the lower casing half;

d) determining the jack height necessary to compensate for the predicted deformation of the gas turbine, and e) adjusting the jacks to the determined height.

5. A method for adjusting jacks supporting a gas turbine as in claim 4 wherein step (d) is performed by determining the jack forces needed to compensate for the predicted gas turbine deformation.

6. A method for adjusting jacks supporting a gas turbine as in claim 4 wherein the jacks are three or more.

* * * * *